United States Patent [19]

Garthaffner et al.

[11] Patent Number: 4,817,638

[45] Date of Patent: Apr. 4, 1989

[54] APPARATUS FOR ADJUSTING A CIGARETTE HAVING VARIABLE SMOKING CHARACTERISTICS

[75] Inventors: Martin T. Garthaffner, Midlothian; Billy J. Keen, Jr., Richmond; Grier S. Fleischhauer, Midlothian; Ronald D. Horaker, Powhaton, all of Va.

[73] Assignee: Philip Morris Incorporated, New York, N.Y.

[21] Appl. No.: 761,631

[22] Filed: Aug. 1, 1989

[51] Int. Cl.[4] ..... A24C 5/60

[52] U.S. Cl. ..... 131/29; 131/27.1; 131/88; 131/93; 131/94

[58] Field of Search ..... 131/94, 95, 280, 29, 131/27.1, 88, 93, 94

[56] References Cited

FOREIGN PATENT DOCUMENTS 0100215 2/1984 European Pat. Off. ..... 131/29

*Primary Examiner*—V. Millin

*Attorney, Agent, or Firm*—Jeffrey H. Ingerman

[57] ABSTRACT

Apparatus for adjusting a cigarette having a variable smoking characteristic to a preselected level of that characteristic is provided. A cigarette having a rotatable element for controlling a smoking characteristic, and assembled with a first level of that characteristic, is adjusted to a preselected second level by a drum and cooperating belt which engage the rotatable element and which move relatively faster and slower, or slower and faster, respectively, than a drum and belt holding the remainder of the cigarette.

32 Claims, 7 Drawing Sheets

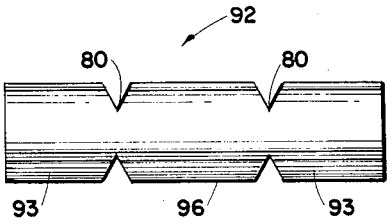
Fig. 9a
Fig. 10
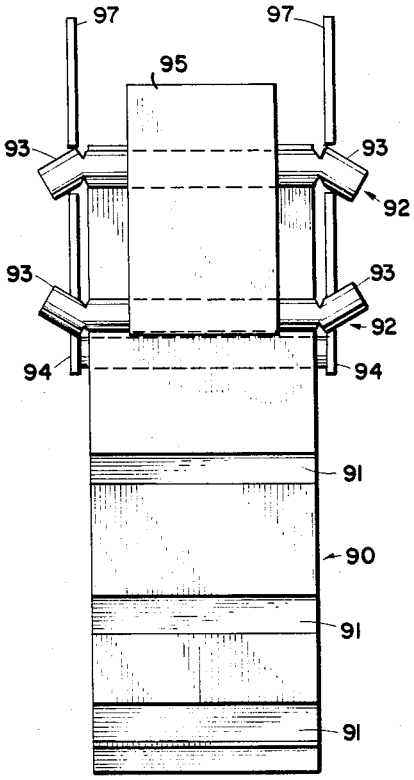

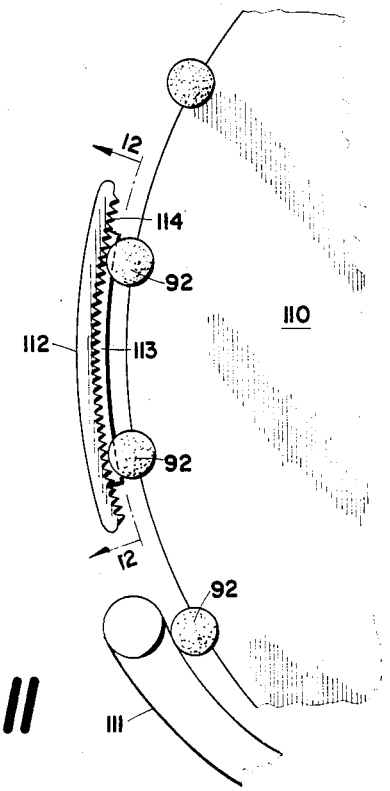
Fig. 11
Fig. 12
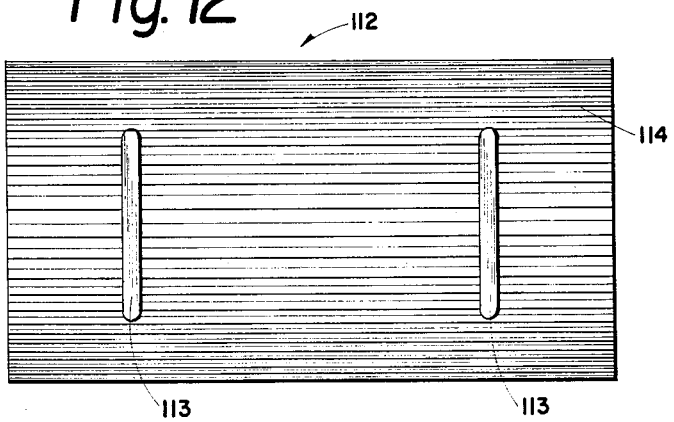

APPARATUS FOR ADJUSTING A CIGARETTE HAVING VARIABLE SMOKING CHARACTERISTICS

BACKGROUND OF THE INVENTION

This invention relates to the manufacture of cigarettes having variable smoking characteristics, and particularly to apparatus for adjusting the dilution level of variable dilution cigarette after assembly.

It is known to produce variable dilution cigarettes having integral rotatable elements for controlling dilution. The rotatable element can be a rotatable band of tipping paper retained by stationary bands against axial displacement and having a slit overlying a slit in the filter plug wrap with which it can be rotated into and out of registry. Alternatively, it can be a rotatable section of the filter plug, carrying with it a section of tipping paper extending over a stationary section of the filter plug. The extending section of the tipping paper has a slit which overlies a slit in the plug wrap on the stationary filter plug segment. The slits can be moved in and out of registry by rotating the rotatable filter segment. Such a cigarette is described in copending, commonly-assigned United States patent application Ser. No. 429,392, filed Sept. 30, 1982, now U.S. Pat. No. 4,532,943, which is hereby incorporated by reference in its entirety.

In the manufacture of these types of cigarettes, the slits on the tipping paper and plug wrap are most easily formed by simultaneously slitting both layers with a knife or laser beam. The cigarettes are therefore assembled initially with the slits fully in registry and with their dilution levels therefore adjusted to maximum dilution. However, for marketing or other reasons, it may be desirable to adjust the cigarettes to a minimum or intermediate dilution level before they are sold.

It is also known to produce cigarettes in which other smoking characteristics, such as flavoring and resistance-to-draw, are controlled by the rotation of an integral rotatable element. It may be desirable to adjust the position of the rotatable element in these types of cigarettes as well.

It is known to run such cigarettes past a skid plate which frictionally contacts the rotatable element to rotate it and break the perforations holding it in a fixed rotational position relative to the remainder of the cigarette. However, this does not allow for controlled rotation of the rotatable element to a desired position, and also applies translational forces which may damage the cigarette.

SUMMARY OF THE INVENTION

It is therefore an object of this invention to provide apparatus for rotating a rotatable element of a cigarette having a variable smoking characteristic by a controlled amount to a desired level of the variable smoking characteristic.

It is a particular object of this invention to provide apparatus for rotating a rotatable element of a variable dilution cigarette by a controlled amount to a desired dilution level.

In accordance with this invention, apparatus is provided for adjusting a cigarette having a variable smoking characteristic, said cigarette having a tobacco rod, a filter plug, and a rotatable element associated with the filter plug for varying the smoking characteristic, which cigarette is assembled with a first level of the smoking characteristic. The apparatus comprises means for holding the tobacco rod of the cigarette and means for torsionally engaging the rotatable element. The torsional engagement means rotates relative to the holding means for rotating the rotatable element a desired amount to adjust the level of the smoking characteristic to a second level. The apparatus can be part of a cigarette making machine.

BRIEF DESCRIPTION OF THE DRAWINGS

The above and other objects and advantages of invention will be apparent after consideration of the following detailed description, taken in conjunction with the accompanying drawings, in which like reference characters represent like parts throughout, and in which:

FIG. 9A is a cross-sectional view of a double filter plug used with the invention;

FIG. 10 is a plan view taken from line 10—10 of FIG. 9;

FIG. 11 is an elevational view of another optional portion of the apparatus of the invention; and FIG. 12 is an elevational view taken from line 12—12 of FIG. 11.

DETAILED DESCRIPTION OF THE INVENTION

The apparatus of the present invention can be used alone to adjust the dilution levels of cigarettes produced on separate cigarette making machines, or it can be incorporated as part of a cigarette making machine.

Figure 1:
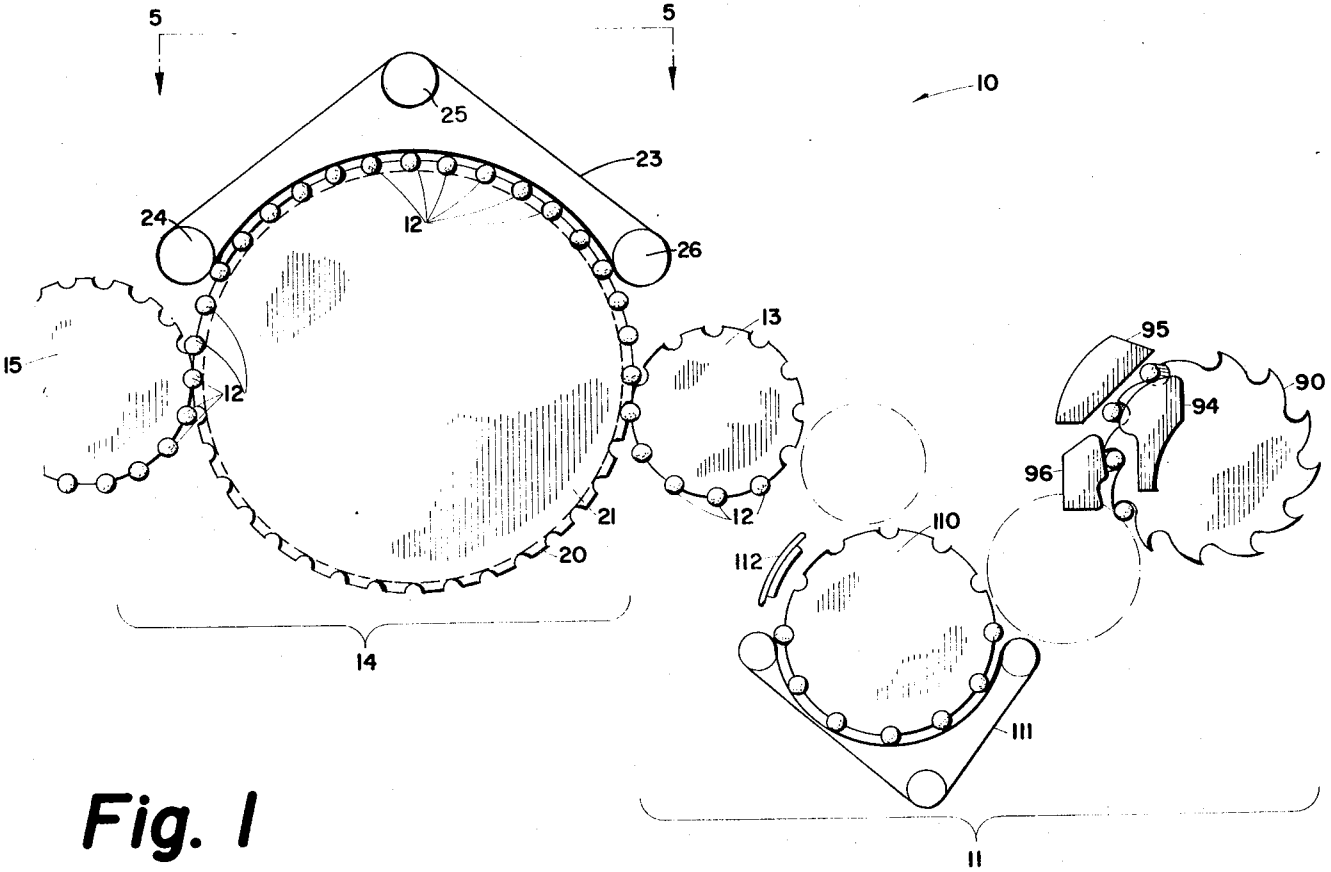
FIG. 1 is a front elevational view of a cigarette making machine according to the invention.

A preferred embodiment of a cigarette making machine 10 incorporating the apparatus of the invention is shown, partly schematically, in FIG. 1. In section 11 of apparatus 10, the tobacco rod is formed, and is joined to a filter plug having a rotatable element by being overwrapped with tipping paper. The tipping paper is divided into a section attached to the rotatable element and extending over part of the nonrotatable portion of the filter plug, and at least one other section attached to the remainder of the filter plug and to the tobacco rod. The extending section of tipping paper attached to the rotatable element, and the underlying plug wrap, are simultaneously slit, preferably with a laser, producing a variable dilution cigarette adjusted to its maximum dilution level. The completed cigarettes 12 are eventually carried onto transfer drum 13.

Transfer drum 13 transfers cigarettes 12 to the apparatus 14 of the invention which adjusts the dilution level from maximum to the desired level, as discussed in more detail below. The adjusted cigarettes are then passed to transfer drum 15 and on for further processing—e.g., packing.

Figure 3:
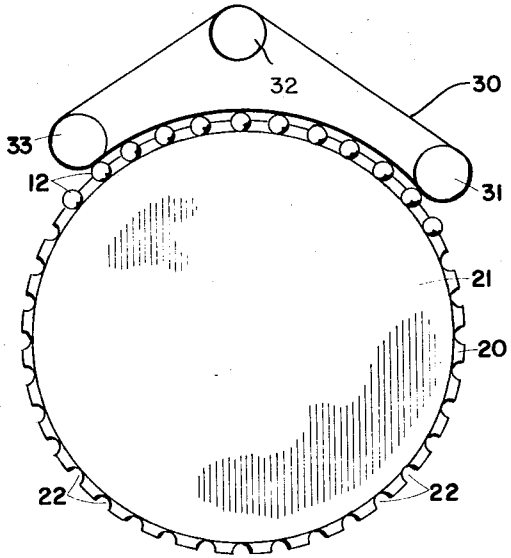
FIG. 3 is a rear elevational view of the smoking characteristic adjusting apparatus of the invention.
Figure 2:
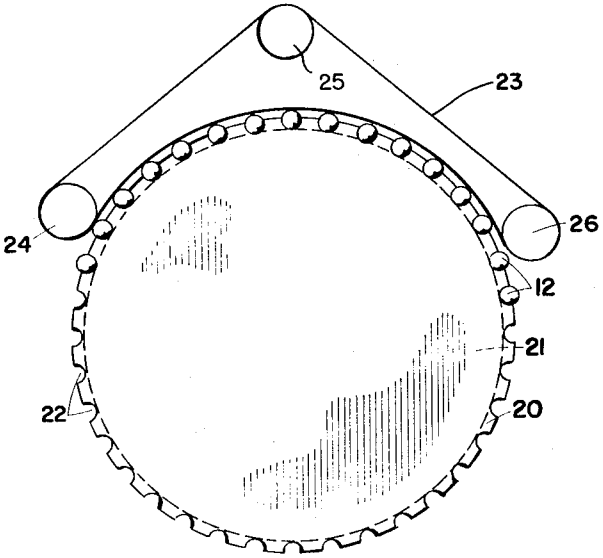
FIG. 2 is a front elevational view of the smoking characteristic adjusting apparatus of the invention.
Figure 5:
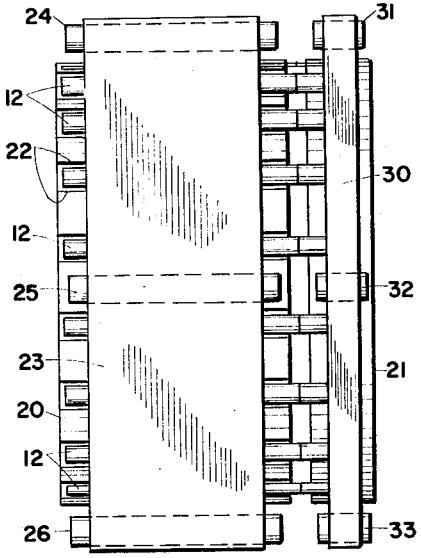
FIG. 5 is a plan view of the smoking characteristic adjusting apparatus of the invention, taken from line 5—5 of FIG. 1.
Figure 4:
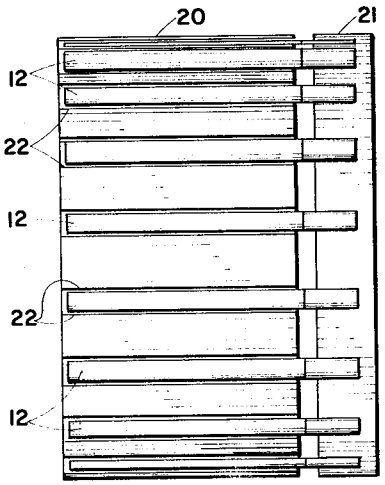
FIG. 4 is a plan view of the first and second drums of the apparatus of the invention.

Apparatus 14, shown in more detail in FIGS. 2–4, includes two concentric drums 20, 21. Drum 20 has flutes 22 for receiving cigarettes 12, and is approximately as wide as the length of the tobacco rod of a cigarette 12. The filter portions of cigarettes 12 project from drum 20 and extend over drum 21.

The radius of drum 21 is smaller than that of drum 20 by an amount equal to the depth of flutes 22, so that the filter portions of cigarettes 12 rest on the surface of drum 21 without cigarettes 12 bending. The width of drum 21 and its spacing from drum 20 are chosen so that only the rotatable element of the filter portion of each cigarette 12 contacts the surface of drum 21.

A tension belt 23 runs on rollers 24, 25, 26 and follows the surface of drum 20. Tension belt 23 moves at the same speed as the peripheral surface of drum 20 and holds cigarettes 12 firmly in flutes 22 while preventing their rotation. If desired, the surface of drum 20, particularly flutes 22, can be coated with an abrasive material or any other material that will enhance the frictional engagement between drum 20 and cigarettes 12.

A tension belt 30 runs on rollers 31, 32, 33 and follows the surface of drum 21. Drum 21 is coated with a nickel-diamond coating, or it can be coated with rubber or other friction enhancing material. Drum 21 is driven so that its peripheral surface advances at a first speed in a first direction relative to the peripheral surface of drum 20, but in the same direction as seen by an observer. Belt 30 is driven to advance at a corresponding speed in a second direction relative to the peripheral surface of drum 20 and is sized and placed to contact only the rotatable element of cigarette 12. Therefore, while the main body of cigarette 12 is held against rotation by drum 20 and belt 23, opposite sides of the rotatable element of cigarette 12 are moved the same amount in opposite directions by drum 21 and belt 30. This results in a torque about the rotatable element, but no translational force on cigarette 12. Therefore, the rotatable element rotates, but cigarette 12 is not moved or bent. Drum 21 and belt 30 will always be driven in the same direction as drum 20 as seen by an observer. However, depending on the direction—i.e., clockwise or counterclockwise—it is desired to rotate the rotatable element, one of drum 21 and belt 30 will travel slower than drum 20 and the other will travel faster.

The degree of rotation of the rotatable element can be controlled by controlling either the relative speeds of drum 21 and belt 30 compared to that of drum 20, or the length of time that the rotatable element is engaged by drum 21 and belt 30, or both. For example, either or both of rollers 31 and 33 could be adjustably mounted to allow the path length over which the rotatable element is engaged to be varied. However, the path length over which the rotatable element is engaged by drum 21 and belt 30 should at most be coextensive with the path length over which cigarette 12 is engaged by belt 23, if the main body of cigarette 12 is to be held while the rotatable element is rotated.

The desired degree of rotation of the rotatable element depends on the desired dilution level and the parameters of cigarette 12. For example, if the slots in the rotatable element and the underlying plug wrap cover one quarter of the circumference of the cigarette, and it is desired to move them completely out of registry, then, assuming a cigarette with a circumference of 25 mm, drum 21 should advance 6.25 mm less (or more), and belt 30 should advance 6.25 mm more (or less), than drum 20 and belt 23 together advance during the time that the rotatable element of cigarette 12 is engaged.

As is typical in cigarette making machines, vacuum can be applied to flutes 22, and to the flutes of the transfer drums 13 and 15, to hold cigarettes 12 on the drums, particularly where they are not being held by belts 23 and 30. The vacuum applied to the various drums can be arranged to release a cigarette 12 from one drum as it approaches the next drum, to which vacuum would than be applied to cause cigarette 12 to pass to the next drum, in a known manner.

Figure 6:
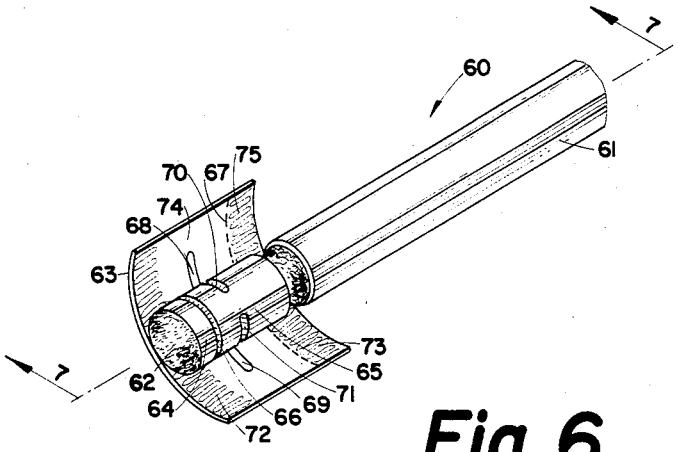
FIG. 6 is a fragmentary, partially exploded, perspective view taken from the mouth end of a cigarette with which the invention can be used.
Figure 7:
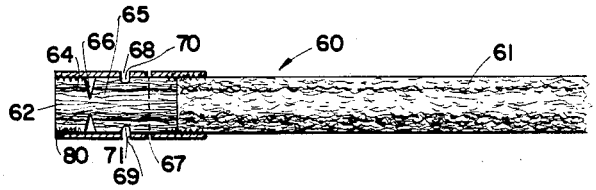
FIG. 7 is a longitudinal cross-section view of the cigarette of FIG. 6, taken from line 7—7 of FIG. 6.
Figure 8:
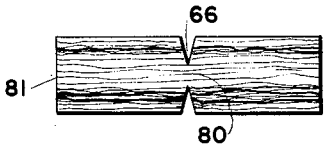
FIG. 8 is a longitudinal cross-sectional view of the filter plug of the cigarette of FIGS. 6 and 7.

The type of cigarette described in said above-incorporated copending, commonly-assigned application, now U.S. Pat. No. 4,532,943, is illustrated in FIGS. 6–8. The cigarette 60 comprises a tobacco rod 61, that is, a charge of tobacco wrapped in cigarette paper, attached to an axially aligned, wrapped cylindrical filter plug 62, and tipping paper 63. The filter plug 62 has a mouth end and a rod end, both of which are open to permit passage of air and smoke, and is divided into first and second segments 64, 65 by a circumferentially extending cut 66 which defines a central, axial core 80 about which the first segment 64 can be rotated relative to the second segment 65. The tipping paper 63 circumscribes and joins the filter plug 62 to the tobacco rod 61 in abutting end-to-end relation, and extends from substantially the mouth end of the filter plug 62, where it is fastened by adhesive band 72, to a point on the tobacco rod 61 adjacent the rod end of the filter plug 62, where it is fastented to both segment 65 and tobacco rod 61 by adhesive band 73, and has a perforated break line 67 at a point between the circumferential cut 66 and the tobacco rod 61, dividing it into two tipping paper sections 74, 75.

Two openings 68, 69 are made through the tipping paper 63 corresponding to two openings 70, 71 in the underlying portion of the filter plug wrap. When perforation line 67 is broken, tipping paper section 74 is free to rotate with first segment 64 of the filter plug 62 about the axis of central core 80, such that openings 68, 69 in the tipping paper 63 and openings 70, 71 in the underlying portion of the plug wrap are in varying degrees of registry to permit varying amounts of air to enter the filter and combine with the smoke, thereby varying the air dilution value of the cigarette.

As described above, such cigarettes are assembled by providing a filter plug such as filter plug 81, shown in FIG. 8, and attaching it to a tobacco rod 61 by overwrapping both plug 81 and rod 61 with a length of tipping paper 63 which has already been provided with perforated break line 67. The tipping paper 67 is bonded by adhesive band 72 to the mouth end of filter plug 81 and by adhesive band 73 to the rod end of filter plug 81 and to the adjacent end of tobacco rod 61. A pair of slits is made through both tipping paper 63 and the wrapping of filter plug 81 by a knife or laser beam, or other suitable means, simultaneously forming openings 68 and 70 and openings 69 and 71, transforming filter plug 81 into filter plug 62.

When segment 64 of filter plug 62 is rotated immediately after being assembled as described above, the twisting of central axial core 80 will cause core 80 to tend to shorten. However, because the portions of opposing filter plug segments 64, 65 radially outward of core 80 are in direct contact, core 80 cannot shorten. Instead, the fibers of core 80 stretch or lengthen to maintain the same overall core length while twisted. Because of the stresses and strains involved, they may never return to their original lengths. As a result, when segment 64 is rotated toward a more relaxed position of core 80, segment 64 may move slightly away from segment 65. Therefore, even when openings 68, 69 and 70, 71 are in rotational alignment, they may no longer be in longitudinal alignment, and the functioning of the variable dilution mechanism may be impaired.

Figure 9:
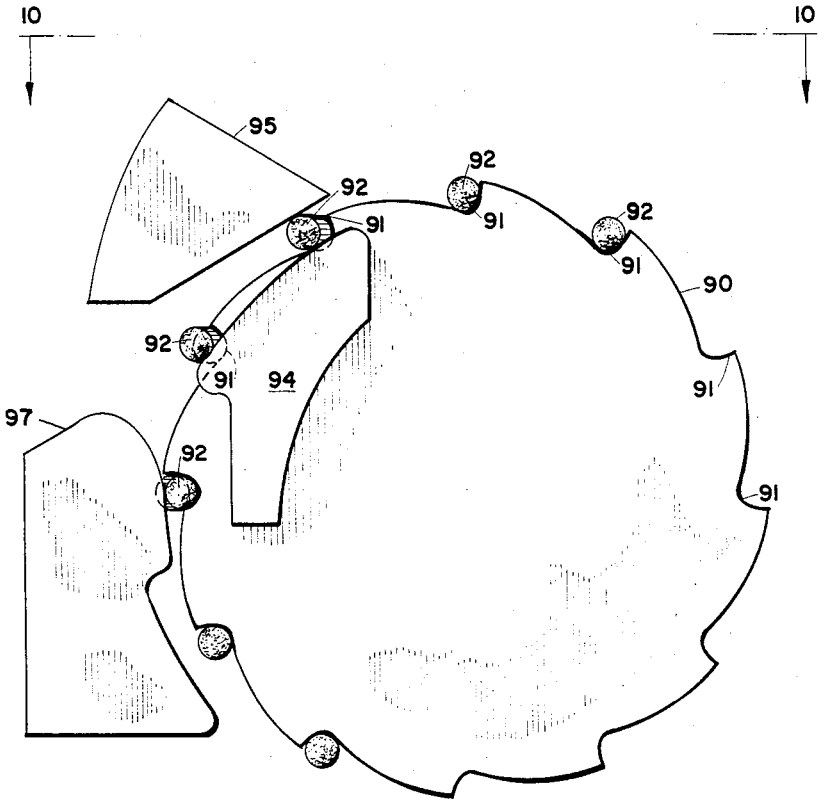
FIG. 9 is a elevational view of an optional portion of the apparatus of the invention.

Therefore, FIGS. 9 and 10 illustrate means which can be provided in apparatus 10 to pre-stress central axial core 80 prior to the assembly of the cigarette, so that after openings 68, 69 and 70, 71 are formed, they remain in longitudinal alignment even when segment 64 is rotated. Drum 90 receives plugs 81 from a hopper (not shown) into flutes 91 on the surface thereof. In practice, double plugs 92, such as are shown in FIG. 9A, are used, for attachment to two tobacco rods. Filter plug 92 is then severed down the middle to form two cigarettes. Plugs 92 are received in flutes 91 such that segments 93 at either end hang over the edges of drum 90. As drum 90 rotates (counterclockwise in the case of the drum illustrated in FIG. 9), plugs 92 contact cams 94 and block 95. Block 95 holds center section 96 of plug 92 against drum 90 while cams 94 bend segments 93 outward from the drum axis to pre-stress central axial cores 80. Plugs 93 then contact cams 97 which bend segments 93 in the other direction to complete the pre-stressing of cores 80. Plugs 93 then continue through the cigarette making process. If desired, the pre-stressing operation can be carried out on separate apparatus and the pre-stressed plugs can then be loaded into apparatus 10.

Another situation which may arise in the assembly of the described cigarettes is that if the material used for tipping paper 63 is too heavy, perforated break lines 67 may be so strong that apparatus 14 will twist the entire cigarette 60 instead of breaking the perforations and rotating segment 64. In order to avoid this situation, a break plate 112 can be provided adjacent drum 110 (about which cigarettes 60 are rolled by belt 111 in order to wrap tipping paper 63 around them). As shown in more detail in FIGS. 11 and 12, break plate 112 has two dull projections or blades 113 which are aligned so that they press immediately adjacent the pair of perforations 67 on each double cigarette which passes by. The surface 114 of the plate 112 is designed to provide sufficient friction to keep cigarettes 92 rolling even though they are no longer in contact with belt 111, so that blades 113 can press on each perforated line 67 about the entire circumference of cigarette 92. This results in the breakage of perforations 67, or in sufficient weakening thereof, to allow apparatus 14 to rotate segments 64.

One skilled in the art will recognize that the inventive principles disclosed herein can be practiced by other than the embodiments shown, which are presented for the purposes of illustration and not of limitation, and the present invention is limited only by the claim which follow.

What is claimed is:

1. Apparatus for adjusting a cigarette having a variable smoking characteristic, said cigarette having a tobacco rod, a filter plug, and a rotatable element associated with said filter plug for varying said smoking characteristic, said cigarette having been assembled with a first level of said smoking characteristic on a cigarette making machine, said apparatus comprising:

means for holding said tobacco rod of said cigarette, means for torsionally engaging said rotatable element, said torsional engagement means moving relative to said holding means for rotating said rotatable element a desired amount, thereby adjusting said level of said smoking characteristic to a second dilution level.

2. The apparatus of claim 1 wherein said smoking characteristic is the degree of dilution of said cigarette.

3. The apparatus of claim 1 wherein said holding means comprises a first rotating drum and a tension element adjacent at least a portion of the peripheral surface of said first rotating drum, said tension element advancing at the same speed as said peripheral surface, said cigarette being held between said tension element and said peripheral surface, the extent of said portion of said peripheral surface being determined by the rotational speed of said first rotating drum and the desired amount of rotation of said rotatable element.

4. The apparatus of claim 3 wherein said tension element is a belt.

5. The apparatus of claim 3 wherein said first rotating drum has a plurality of flutes in said peripheral surface thereof for holding a plurality of said cigarettes.

6. The apparatus of claim 5 further comprising a source of vacuum and means for applying said vacuum to each of said flutes for holding said cigarettes in said flutes.

7. The apparatus of claim 1 wherein said torsional engagement means comprises a first engagement means moving in a first direction relative to said holding means and a second engagement means moving in a second direction relative to said holding means.

8. The apparatus of claim 3 wherein said torsional engagement means comprises a first engagement means moving in a first direction relative to said holding means and a second engagement means moving in a second direction relative to said holding means.

9. The apparatus of claim 8 wherein said first engagement means is a second rotating drum concentric with said first rotating drum and having a frictional surface and said second engagement means is a tension element.

10. The apparatus of claim 9 wherein said frictional surface is rubberized.

11. The apparatus of claim 9 wherein said frictional surface is abrasive.

12. The apparatus of claim 11 wherein said abrasive surface is nickel-diamond coated.

13. The apparatus of claim 9 wherein said tension element is a belt adjacent a portion of the peripheral surface of said second rotating drum at most coextensive with said portion of said peripheral surface of said first rotating drum.

14. The apparatus of claim 7 wherein said first and second engagement means move at speeds which are equal and opposite with respect to said holding means.

15. In combination:

the apparatus of claim 1, and a cigarette making machine, said maching having a first transfer drum adjacent said holding means of said apparatus for transferring cigarettes to said holding means.

16. The combination of claim 15 wherein:

said holding means comprises:

a first rotating drum having a plurality of flutes in the peripheral surface thereof for holding a plurality of said cigarettes, a source of vacuum, means for applying said vacuum to each of said flutes for holding said cigarettes in said flutes, and a first tension belt adjacent at least a portion of the peripheral surface of said first rotating drum and advancing at the same speed as said peripheral surface, said portion of said peripheral surface being determined by the speed of said drum and the desired amount of rotation of said rotatable element;

said frictional engagement means comprises a second rotating drum concentric with said first rotating drum and having a frictional surface rotating in a first direction relative to said first rotating drum and a second tension belt adjacent a portion of the peripheral surface of said second rotating drum at most coextensive with said portion of said peripheral surface of said first rotating drum and moving parallel to said peripheral surface of said second rotating drum in a second direction relative to said first rotating drum; and said peripheral surface of said second rotating drum and said second tension belt advance at speeds which are equal and opposite with respecte to said peripheral surface of said first rotating drum.

17. The combination of claim 16 where said frictional surface is nickel-diamond coated.

18. The apparatus of claim 15 wherein said rotatable element is a first segment of said filter plug, said first segment being rotatably connected to a second segment of said filter plug by a central axial core of filter tow material defined by a circumferential cut about said filter plug, said apparatus further comprising means for prestressing said central axial core before said filter plug is attached to a tobacco rod.

19. The apparatus of claim 18 wherein said pre-stressing means comprises:

a second transfer drum located in a portion of said cigarette making machine ahead of the portion wherein said filter plug is attached to said tobacco rod;

means for holding said second segment of said filter plug on said second transfer drum; and cam means adjacent said second transfer drum for bending said first segment away from the axis of said filter plug.

20. The apparatus of claim 18 wherein said frictional surface is nickel-diamond coated.

21. The apparatus of claim 15 wherein said rotatable element is a segment of said filter plug, said segment having a section of tipping paper affixed thereto, said section being attached to an adjacent section of tipping paper by a row of perforations, said apparatus further comprising means for breaking said row of perforations, thereby allowing rotation of said rotatable element.

22. The apparatus of claim 21 wherein said cigarette making machine comprises a rolling drum which rotates at a first speed, said rolling drum having a belt adjacent thereto moving at a second speed different from said first speed such that cigarettes roll along the surface of said rolling drum, between said belt and said surface, to wrap said perforated tipping paper about said cigarettes, said apparatus comprising a break plate adjacent said rolling drum for breaking said row of perforations.

23. The apparatus of claims 22 wherein said break plate comprises a frictional surface such that said cigarettes continue to roll while between said break plate and said rolling drum and a blade for pressing on said row of perforations for breaking said perforations.

24. A cigarette making machine comprising:

means for assembling a variable dilution cigarette of the type having a tobacco rod, a filter plug, and a rotatable element associated with said filter plug for varying said dilution level, said assembling means assembling said cigarette with a first dilution level;

a transfer drum for receiving cigarettes from said assembling means;

a first rotating drum having a plurality of flutes in the peripheral surface thereof for receiving a plurality of said cigarettes from said transfer drum and holding the tobacco rods of said plurality of cigarettes;

a source of vacuum;

means for applying said vacuum to each of said flutes for holding said tobacco rods in said flutes;

a first tension belt adjacent at least a portion of said peripheral surface of said first rotating drum of advancing at the same speed as said peripheral surface;

a second rotating drum concentric with said first rotating drum and having a frictional surface for engaging said rotatable elements, said second rotating drum rotating relative to said first rotating drum at a predetermined speed in a first direction;

a second tension belt adjacent a portion of the peripheral surface of said second rotating drum at most coextensive with said portion of said peripheral surface of said first rotating drum, said second tension belt engaging said rotatable elements and advancing relative to said peripheral surface of said first rotating drum at said predetermined speed in a second direction opposite to said first direction;

whereby said rotatable elements are rotated a preselected amount to adjust said cigarettes to a desired second dilution level, said portions of said peripheral surfaces and said predetermined speed being selected such that said rotatable elements rotate said predetermined amount to achieve said desired second dilution level.

25. The apparatus of claim 24 wherein said frictional surface is nickel-diamond coated.

26. The apparatus of claim 24 wherein said rotatable element is a first segment of said filter plug, said first segment being rotatably connected to a second segment of said filter plug by a central axial core of filter tow material defined by a circumferential cut about said filter plug, said apparatus further comprising means for pre-stressing said central axial core before said filter plug is attached to a tobacco rod.

27. The apparatus of claim 25 wherein said pre-stressing means comprises:

a second transfer drum located in a portion of said cigarette making machine ahead of the portion wherein said filter plug is attached to said tobacco rod;

means for holding said second segment of said filter plug on said second transfer drum; and cam means adjacent said second transfer drum for bending said first segment away from the axis of said filter plug.

28. The apparatus of claim 24 wherein said rotatable element is a segment of said filter plug, said segment having a section of tipping paper affixed thereto, said section being attached to an adjacent section of tipping paper by a row of perforations, said apparatus further comprising means for breaking said row of perforations, thereby allowing rotation of said rotatable element.

29. The apparatus of claim 28 wherein said cigarette making machine comprises a rolling drum which rotates at a first speed, said rolling drum having a belt adjacent thereto moving at a second speed different from said first speed such that cigarettes roll along the surface of said rolling drum, between said belt and said surface, to wrap said perforated tipping paper about said cigarettes, said apparatus comprising a break plate adjacent said rolling drum for breaking said row of perforations.

30. The apparatus of claim 29 wherein said break plate comprises a frictional surface such that said cigarettes continue to roll while between said break plate and said rolling drum and a blade for pressing on said row of perforations for breaking said perforations.

31. Apparatus for pre-stressing the central axial core of a cigarette filter plug, said cigarette filter plug being of the type having first and second segments relatively rotatable about a central axial core defined by a circumferential cut about said filter plug, said apparatus comprising means for holding one of said segments of said filter plug and means for bending the other of said segments away from the axis of said filter plug.

32. The apparatus of claim 31 further comprising a rotating drum, wherein said holding means holds said one of said segments on the surface of said rotating drum and wherein said bending means comprises at least one cam means adjacent said rotating drum.

* * * * *

UNITED STATES PATENT AND TRADEMARK OFFICE

CERTIFICATE OF CORRECTION

PATENT NO. : 4,817,638

DATED : April 4, 1989

INVENTOR(S) : Martin T. Garthaffner et al.

It is certified that error appears in the above-identified patent and that said Letters Patent is hereby corrected as shown below:

Column 1, line 10, "cigarette" should be -- cigarettes --.

Column 2, line 11, after "of" should be inserted -- the --;

line 36, "a" should be -- an --.

Column 4, line 15, "than" should be -- then --;

line 35, "fastented" should be --fastened --.

Column 5, line 61, "claim" should be -- claims --.

Claim 15, column 6, line 63, "maching" should be -- machine --.

Claim 16, column 7, line 27, "respecte" should be -- respect --.

Signed and Sealed this

Twenty-third Day of January, 1990

*Attest:*

JEFFREY M. SAMUELS

*Attesting Officer* *Acting Commissioner of Patents and Trademarks*